US005673848A

United States Patent [19]

Garza

[11] Patent Number: 5,673,848

[45] Date of Patent: Oct. 7, 1997

[54] CORRUGATED BOX HAVING CORNER SUPPORT POSTS

[76] Inventor: Juan Ramon Garza, Km. 9.9 Carretera, Culiacan-Eldorado, Mexico

[21] Appl. No.: 680,783

[22] Filed: Jul. 16, 1996

Related U.S. Application Data

[63] Continuation of Ser. No. 411,268, Mar. 27, 1995, Pat. No. 5,535,941.

[51] Int. Cl.[6] ..... B65D 21/032

[52] U.S. Cl. ..... 229/191; 229/915; 229/918; 229/919

[58] Field of Search ..... 229/191, 915, 229/918, 919

[56] References Cited

U.S. PATENT DOCUMENTS

| | | | |
|---|---|---|---|
| 3,079,058 | 2/1963 | Russell | 229/191 |
| 3,162,351 | 12/1964 | Rudofski | 229/191 |
| 4,056,223 | 11/1977 | Williams | 229/191 |
| 4,236,664 | 12/1980 | Hartelmüller | 229/191 |
| 4,417,686 | 11/1983 | Wozniacki | 229/191 |
| 5,002,221 | 3/1991 | Ragan | 229/191 |
| 5,261,594 | 11/1993 | Brown | 229/191 |
| 5,294,044 | 3/1994 | Clark | 229/191 |
| 5,333,777 | 8/1994 | Roth | 229/191 |
| 5,535,941 | 7/1996 | Garza | 229/191 |

*Primary Examiner*—Gary E. Elkins

*Attorney, Agent, or Firm*—Rhodes, Coats & Bennett, L.L.P.

[57] ABSTRACT

The present invention provides a improved corrugated cardboard box formed from a single pre-cut and pre-scored blank. The box can better support vertical and lateral loads, such as are present when many like boxes are stacked in a column, making the box ideal for packaging and shipping easily damaged produce such as tomatoes. The box is typical in that it includes a bottom panel, two side panels, two top panels, and two end panels. The improvement resides in the provision of a corner support post at each corner of the box. Each corner support post includes a vertically extending corner support panel, which is attached to the side edge of the end panel, and an interior bracing panel which extends from the corner support panel to the inner surface of the end panel. In a preferred embodiment, the post also includes a connecting panel disposed between the corner support panel and the interior bracing panel.

15 Claims, 5 Drawing Sheets

CORRUGATED BOX HAVING CORNER SUPPORT POSTS

This application is a continuation of application Ser. No. 08/411,268, filed Mar. 27, 1995, U.S. Pat. No. 5,535,941.

FIELD OF THE INVENTION

The present invention relates to corrugated boxes and particularly relates to a corrugated cardboard box for containing produce and the like, which is reinforced at each corner to provide improved strength and to enable stacking of a number of like boxes.

BACKGROUND OF THE INVENTION

Corrugated cardboard boxes are well known and are commonly used to store and ship various goods such as produce. Such boxes are typically made from a single sheet of corrugated cardboard, referred to as a blank, that is cut, scored, and then folded along the score lines into a certain shape where it is then glued or otherwise held together. One problem associated with such boxes is their lack of vertical strength, which precludes stacking of full boxes beyond a certain height, necessitating additional supports or shipping pallets to prevent damage to the contents of the boxes.

One box design that attempts to solve the aforementioned problem is the produce container disclosed in U.S. Pat. No. 5,002,224 to Muise. Muise discloses a cardboard container that provides improved vertical support by including an additional vertical support section hingedly attached to the end panels of the container. Each vertical support section of Muise consists of two narrow vertical panels set at a 90 degree angle to the end panel with one of the narrow vertical panels having a tab member hingedly attached to the top of the narrow vertical panel. Each tab member forms a horizontal corner platform that transfers vertical loads to the narrow vertical panels. Each tab member also includes an extension that overlies a portion of the top edge of the adjacent end panel to transfer vertical loads to the end panel as well.

While Muise provides more vertical stacking support than a typical non-reinforced cardboard box, the Muise design leaves room for improvement. Because the vertical support panels of Muise only extend in one direction relative to the end panel, there is little provision for lateral stress on the container. Lateral stress may distort or bend the hinged vertical supports, which may result in collapse of the container and damage to the contents. Additionally, the tab member of Muise does not carry any vertical loads by itself but only transfers loads to adjacent panels through its connection to the vertical support and its extension resting atop the end panel. Therefore, the tab member and its extension are for the most part unnecessary, merely acting as an additional layer of box top. Thus, there is a need for an improved vertical corner support in a box formed from a single sheet of corrugated cardboard.

SUMMARY AND OBJECTS OF THE INVENTION

The present invention provides a corrugated cardboard box that provides greater vertical and lateral support than prior art designs. The box of the present invention, which is ideal for packaging and shipping produce such as tomatoes, includes a bottom panel and a plurality of side walls attached to respective edges of the bottom panel. The side walls are joined at each end to an adjacent sidewall to form a closed wall structure having a plurality of corners. The improvement resides in the provision of a corner support structure at each corner of the box which forms an open support column or post. The support column includes an interior bracing panel that extends between adjacent side walls in spaced relationship to the corner of the box so as to form an open column at each corner of the box. In the preferred embodiment, each corner support post includes a vertically extending corner support panel, which is attached to one side wall and extends alongside the inner surface of an adjacent side wall. The interior panel consists of a single diagonal support panel which is connected either directly to the corner support panel, or indirectly by a connecting panel. The interior bracing panel serves as an additional load-bearing member and also provides resistance to lateral forces.

It is therefore an object of the present invention to provide an improved box formed from a single, folded sheet of corrugated cardboard that better supports vertical loads to prevent damage to contents of the box caused by stacking like boxes on top of each other.

It is another object of the present invention to provide a cardboard box having corner support posts that carry relatively large vertical loads and resist distortion and resulting collapse caused by lateral forces or impacts.

Other objects and advantages of the present invention will become apparent and obvious from a study of the following description and the accompanying drawings, which are merely illustrative of such invention.

DETAILED DESCRIPTION OF THE INVENTION

Figure 1:
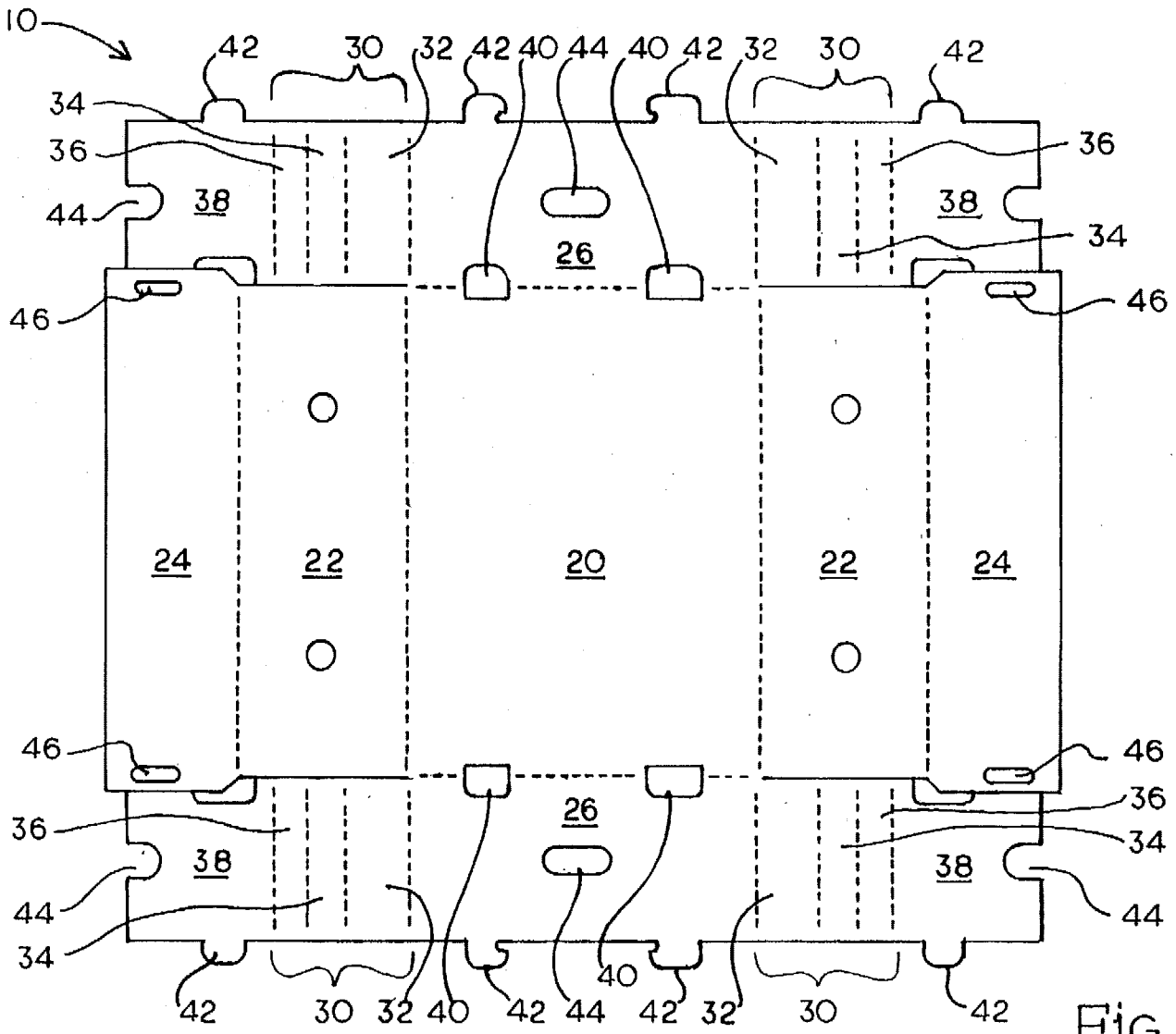
FIG. 1 is a plan view of a pre-cut and pre-scored corrugated cardboard blank that forms the box of the present invention.

FIG. 1 shows a packaging material blank that forms the box 10 of the invention. Box 10 is preferably made of typical corrugated Cardboard of any desirable density and thickness and may be coated with wax or a film if desired for moisture resistance. The blank in FIG. 1 has been pre-cut to the correct configuration, as shown by solid lines, and pre-scored for precise folding, as shown by dashed lines. As is typical in most corrugated cardboard boxes used for shipping produce and the like, box 10 includes a bottom panel 20, and a plurality of vertical side walls attached to respective edges of the bottom panel 20. The box 10 shown in the drawings has four side walls. The two longer side walls will be referred to hereinafter as the side panels 22 while the shorter walls will be referred to as the end panels 26.

The side panels 22 and end panels 26 fold upwardly to form a closed wall structure having four corners. A pair of top panels 24 are attached to respective side panels. 22. The top panels 24 fold downwardly to parallel the bottom panel 20. The top panels 24 are slightly longer than the side panels 22 so that the extensions of the top panels 24 rest on the top edge of the end panels 26. The top panels 24 include locking apertures 46 at each end that engage corresponding locking tabs 42 on the end panels 26 to secure the top panels 24. The locking tabs 42 of one box 10 fit into the stacking apertures 40 of another box 10 when the boxes 10 are stacked on top of one another.

In order to provide greater strength for stacking, each box 10 includes a corner support structure that forms an open corner support post or column 30 at each corner of the box 10. As will be explained below, the corner support posts 30 give the box of the present invention its load-carrying ability.

Figure 2:
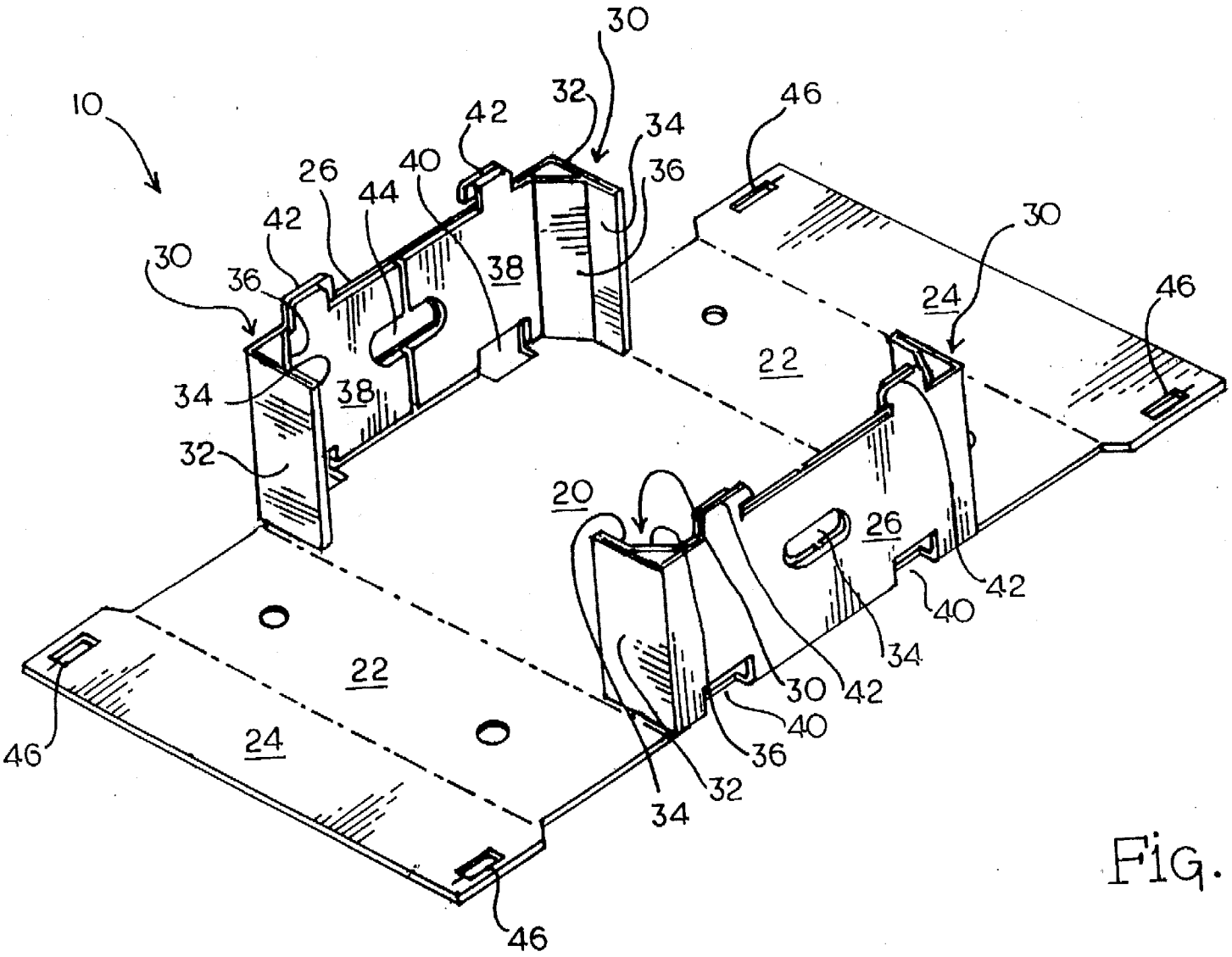
FIG. 2 is a perspective view of a partially assembled box of the invention having a corner support post of the preferred embodiment.
Figure 2A:
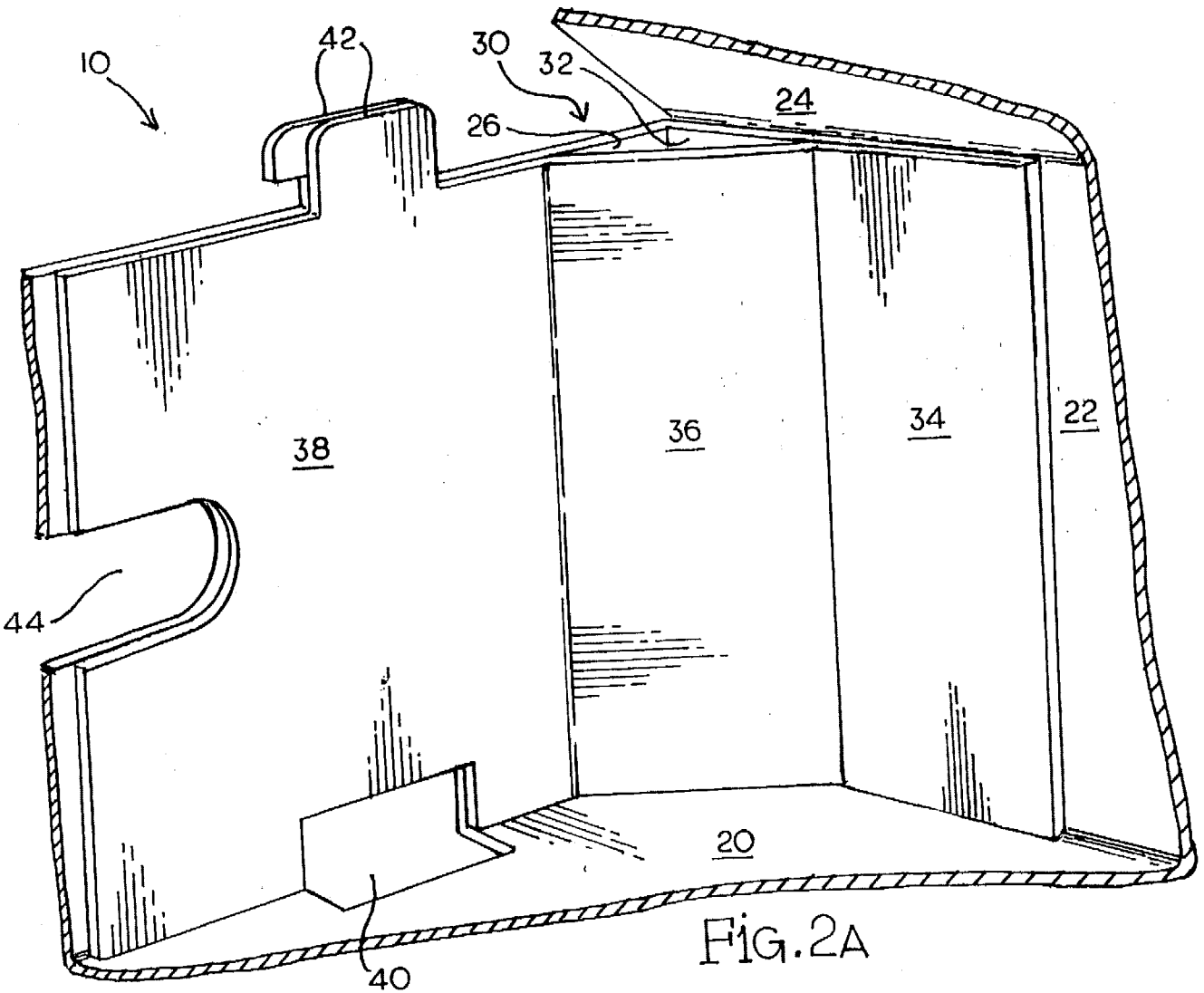
FIG. 2A is an enlarged perspective view of the preferred embodiment of the corner support post in a partially assembled box of the invention.

FIGS. 2 and 2A show a partially assembled box 10 of the invention with FIG. 2A detailing a preferred embodiment of the corner support posts 30. For convenience, only one corner support post 30 will be described herein, although it should be appreciated that all four posts 30 are preferably identical. The corner support post 30 includes a corner support panel 32 and an interior bracing panel 36. Preferably, but not necessarily, each corner support post 30 also include a connecting panel 34 between the corner support panel 32 and the interior bracing panel 36. End reinforcing panels 38 are attached to the interior bracing panel 36.

The corner support panel 32 is folded at a 90° angle to the end panel 26 in such a way that the outer surface of the corner support panel 32 is disposed adjacent the inner surface of the adjacent side panel 22 when the box is assembled. The corner support panel 32 is preferably glued to the adjacent side panel 22 by a suitable adhesive. The connecting panel 34, which is connected to the corner support panel 32, folds back against the inner surface of the corner support panel 32. The connecting panel extends approximately half the distance towards the end panel 26. The interior bracing panel 36 is attached to the connecting panel 34 and extends at a 45° angle from the inner surface of the corner support panel 32 to the inner surface of the end panel 26 thereby forming the triangular corner support post 30. As should be appreciated, geometry dictates that the combined width of the connecting panel 34 and the interior bracing panel 36 must be greater than the width of the corner support panel 32. The interior bracing panel 36 acts both as an additional vertical support and as a lateral brace to prevent distortion and flexing of the corner post in the event of lateral impacts or forces that commonly occur during shipping and storage.

Figure 2C:
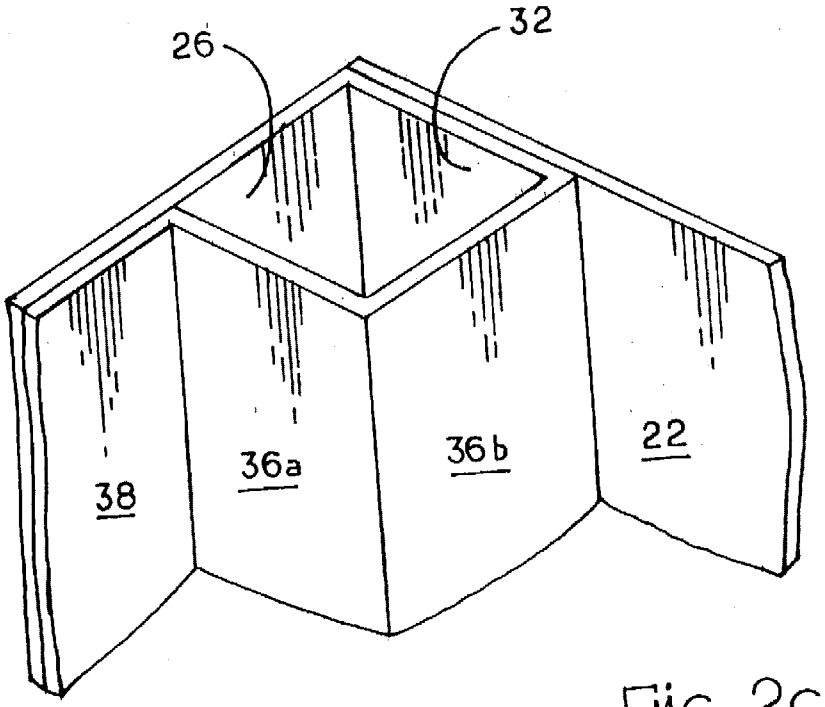
FIG. 2C is an enlarged perspective view of another alternate embodiment of the corner support post.
Figure 2B:
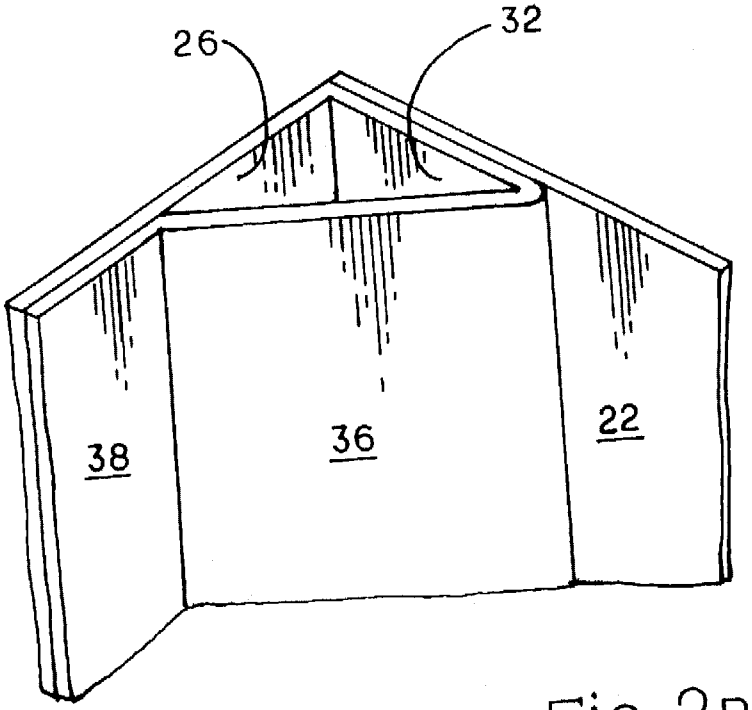
FIG. 2B is an enlarged perspective view of an alternate embodiment of the corner support post.

In an alternate embodiment of the corner support post 30, as shown in FIG. 2B, the connecting panel 34 could be eliminated and the interior bracing panel 36 could be attached directly to the corner support panel 32. In this alternate embodiment of the triangular corner support post, geometry dictates that the width of the interior bracing panel 36 alone would be greater than the width of the corner support panel 32. In another alternate embodiment of the corner support post 30, as shown in FIG. 2C, the interior bracing panel 36 could be replaced by two interior bracing panels **36*a* and 36*b* that form a rectangular corner support post. One panel 36*b* could extend perpendicularly from the corner support panel 32, and the other panel 36*a* could extend perpendicularly to the end panel 26**.

In all embodiments, the end panel 26 of the box is preferably reinforced by the inclusion of two end reinforcing panels 38 that are each connected to the interior bracing panel 36. The end reinforcing panels 38 are disposed against the inner surface of the end panel 26 so as to effectively give the end panel 26 a double walled thickness. Handle apertures 44 are formed though both the end panel 26 and the end reinforcing panels 38.

Figure 3:
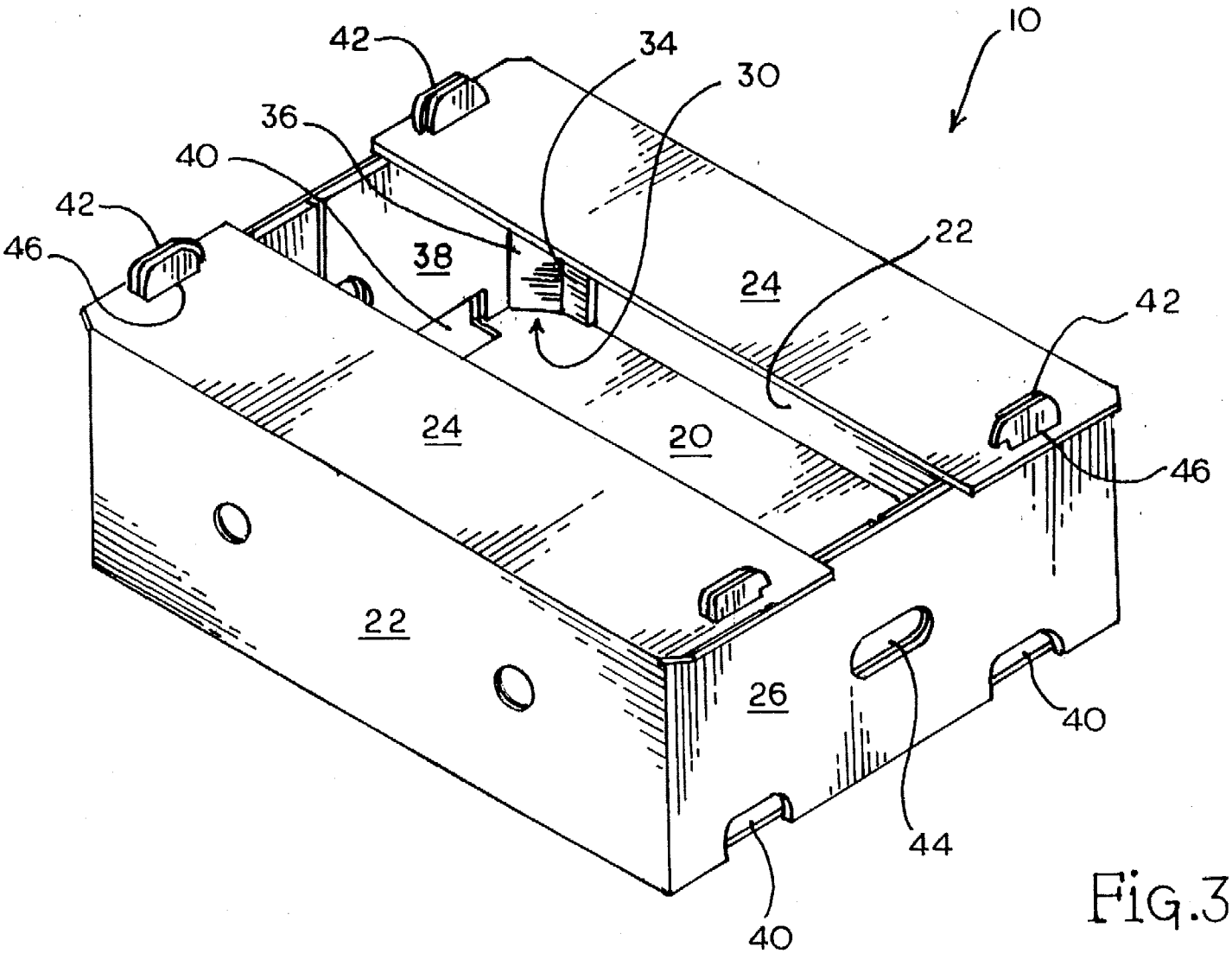
FIG. 3 is a perspective view of an assembled box of the invention.

FIG. 3 shows a completely assembled box of the invention, wherein a corner support post 30 is visible in the far back corner of the box 10. The top panels 24 are held closed by locking tabs 42, which fit through locking apertures 46. As should be appreciated by those in the packing and shipping industry, several like boxes 10 can be stacked on top of each other and held securely in a column by interlocking the locking tabs 42 on each box with stacking apertures 40 in an overlying box. Boxes of the present invention having corner support posts 30 may be stacked far higher than conventional boxes and higher than prior art designs. The greater vertical and lateral strength of the box built according to the present invention is attributable to the addition of an additional vertical support panel and its diagonal disposition to create the three-sided corner column of the invention.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A box having reinforced corners, comprising:

a) a bottom panel;

b) two side panels attached to opposite sides of the bottom panel;

c) two end panels attached to opposite ends of the bottom panel, said end panels meeting with said side panels to form a box with four corners;

d) two top panels, wherein each top panel is attached to a top edge of a respective one of said side panels and overlies two of said corners and at least a portion of an interior of the box;

e) an open, vertically extending triangular corner support column at each corner of said box, each said triangular corner support column consisting essentially of:

i) a corner support panel attached to a respective outer edge of each end panel, each said corner support panel also attached alongside an inner surface of the adjacent side panel, ii) a connecting panel attached to each corner support panel, each said connecting panel folded back against an inner surface of the respective corner support panel and extending back towards the end panel to which the respective corner support panel is attached, and iii) an interior bracing panel attached to each connecting panel, each said interior bracing panel extending at a 45 degree angle from the respective corner support panel to each respective end panel and spaced from the respective corner of said box to form the respective open triangular support column;

f) a reinforcing end panel attached to each interior bracing panel and disposed along an inner surface of a respective end panel, each said reinforcing end panel extending across substantially half of the respective end panel so that adjacent reinforcing end panels give the respective end panel a double walled thickness; and g) box top locking means for securing the top panels down over the interior of the box, said box top locking means comprising a double-thickness locking tab extending upwardly from each end panel and reinforcing end panel, and a locking aperture at each end of the top panels for engaging corresponding locking tabs.

2. The box of claim 1, further comprising stacking apertures disposed in bottom corners of the box through the bottom panel, end panels, and reinforcing end panels, said stacking apertures for engagement by the locking tabs.

3. The box of claim 1, wherein said top panels include extensions so that said top panels are slightly longer than said side panels, said extensions resting on top edges of said end panels.

4. The box of claim 2, further including handle apertures formed at each end of the box through the end panel and the reinforcing end panels.

5. The box of claim 1, wherein said consists of:

a) a bottom panel;

b) two side panels attached to opposite sides of the bottom panel;

c) two end panels attached to opposite ends of the bottom panel, said end panels meeting with said side panels to form a box with four corners;

d) two top panels, wherein each top panel is attached to a top edge of a respective one of said side panels and overlies two of said corners and at least a portion of an interior of the box, said top panels including extensions so that said top panels are slightly longer than said side panels, said extensions resting on top edges of said end panels;

e) an open, vertically extending triangular corner support column at each corner of said box, each said triangular corner support column consisting essentially of:

i) a corner support panel attached to a respective outer edge of each end panel, each said corner support panel also attached alongside an inner surface of the adjacent side panel, ii) a connecting panel attached to each corner support panel, each said connecting panel folded back against an inner surface of the respective corner support panel and extending back towards the end panel to which the respective corner support panel is attached, and iii) an interior bracing panel attached to each connecting panel, each said interior bracing panel extending at a 45 degree angle from the respective corner support panel to each respective end panel and spaced from the respective corner of said box to form the respective open triangular support column;

f) a reinforcing end panel attached to each interior bracing panel and disposed along an inner surface of a respective end panel, each said reinforcing end panel extending across substantially half of the respective end panel so that adjacent reinforcing end panels give the respective end panel a double walled thickness;

g) box top locking means for securing the top panels down over the interior of the box, said box top locking means comprising a double-thickness locking tab extending upwardly from each end panel and each reinforcing end panel and a locking aperture at each end of the top panels for engaging corresponding locking tabs;

h) stacking apertures disposed in bottom corners of the box through the bottom panel, end panels, and reinforcing end panels, said stacking apertures for engagement by the locking tabs; and i) handle apertures formed at each end of the box through the respective end panel and reinforcing end panels.

6. A box having reinforced corners, comprising:

a) a bottom panel;

b) two side panels attached to opposite sides of the bottom panel;

c) two end panels attached to opposite ends of the bottom panel, said end panels meeting with said side panels to form a box with four corners;

d) two top panels, wherein each top panel is attached to a top edge of a respective one of said side panels and overlies two of said corners and at least a portion of an interior of the box;

e) an open, vertically extending triangular corner support column at each corner of said box, each said triangular corner support column consisting essentially of:

i) a corner support panel attached to a respective outer edge of each end panel, each said corner support panel also attached alongside an inner surface of the adjacent side panel, ii) an interior bracing panel attached to each connecting panel, each said interior bracing panel extending at a 45 degree angle from the respective corner support panel to each respective end panel and spaced from the respective corner of said box to form the respective open triangular support column;

f) a reinforcing end panel attached to each interior bracing panel and disposed along an inner surface of a respective end panel, each said reinforcing end panel extending across substantially half of the respective end panel so that adjacent reinforcing end panels give the respective end panel a double walled thickness; and g) box top locking means for securing the top panels down over the interior of the box, said box top locking means comprising a double-thickness locking tab extending upwardly from each end panel and each reinforcing end panel and a locking aperture at each end of the top panels for engaging corresponding locking tabs.

7. The box of claim 6, further comprising stacking apertures disposed in bottom corners of the box through the bottom panel, end panels, and reinforcing end panels, said stacking apertures for engagement by the locking tabs.

8. The box of claim 6, wherein said top panels include extensions so that said top panels are slightly longer than said side panels, said extensions resting on top edges of said end panels.

9. The box of claim 6, further including handle apertures formed at each end of the box through the end panel and the reinforcing end panels.

10. The box of claim 6, wherein said box consists of:

a) a bottom panel;

b) two side panels attached to opposite sides of the bottom panel;

c) two end panels attached to opposite ends of the bottom panel, said end panels meeting with said side panels to form a box with four corners;

d) two top panels, wherein each top panel is attached to a top edge of a respective one of said side panels and overlies two of said corners and at least a portion of an interior of the box, and wherein said top panels include extensions so that said top panels are slightly longer than said side panels, said extensions resting on top edges of said end panels;

e) an open, vertically extending triangular corner support column at each corner of said box, each said triangular corner support column consisting essentially of:

i) a corner support panel attached to a respective outer edge of each end panel, each said corner support panel also attached alongside an inner surface of the adjacent side panel, ii) an interior bracing panel attached to each connecting panel, each said interior bracing panel extending at a 45 degree angle from the respective corner support panel to each respective end panel and spaced from the respective corner of said box to form the respective open triangular support column;

f) a reinforcing end panel attached to each interior bracing panel and disposed along an inner surface of a respective end panel, each said reinforcing end panel extending across substantially half of the respective end panel so that adjacent reinforcing end panels give the respective end panel a double walled thickness;

g) box top locking means for securing the top panels down over the interior of the box, said box top locking means comprising a double-thickness locking tab extending upwardly from each end panel and each reinforcing end panel and a locking aperture at each end of the top panels for engaging corresponding locking tabs;

h) stacking apertures disposed in bottom corners of the box through the bottom panel, end panels, and reinforcing end panels, said stacking apertures for engagement by the locking tabs; and i) handle apertures formed at each end of the box through the end panel and the reinforcing end panels.

11. A box having reinforced corners, comprising:

a) a bottom panel;

b) two side panels attached to opposite sides of the bottom panel;

c) two end panels attached to opposite ends of the bottom panel, said end panels meeting with said side panels to form a box with four corners;

d) two top panels, wherein each top panel is attached to a top edge of a respective one of said side panels and overlies two of said corners and at least a portion of an interior of the box;

e) an open, vertically extending rectangular corner support column at each corner of said box, each said rectangular corner support column consisting essentially of:

i) a corner support panel attached to a respective outer edge of each end panel, each said corner support panel also attached alongside an inner surface of the adjacent side panel, ii) a first interior bracing panel attached to each corner support panel, each said first interior bracing panel extending perpendicularly from the respective corner support panel and spaced from each respective corner of said box, and iii) a second interior bracing panel attached to each first interior bracing panel, each said second interior bracing panel extending perpendicularly from the respective first interior bracing panel to each end panel;

f) a reinforcing end panel attached to each interior bracing panel and disposed along an inner surface of a respective end panel, each said reinforcing end panel extending across substantially half of the respective end panel so that adjacent reinforcing end panels give the respective end panel a double walled thickness; and g) box top locking means for securing the top panels down over the interior of the box, said box top locking means comprising a double-thickness locking tab extending upwardly from each end panel and each reinforcing end panel and a locking aperture at each end of the top panels for engaging corresponding locking tabs.

12. The box of claim 11, further comprising stacking apertures disposed in bottom corners of the box through the bottom panel, end panels, and reinforcing end panels, said stacking apertures for engagement by the locking tabs.

13. The box of claim 11, wherein said top panels include extensions so that said top panels are slightly longer than said side panels, said extensions resting on top edges of said end panels.

14. The box of claim 11, further including handle apertures formed at each end of the box through the end panel and the reinforcing end panels.

15. The box of claim 11, wherein said box consists of:

a) a bottom panel;

b) two side panels attached to opposite sides of the bottom panel;

c) two end panels attached to opposite ends of the bottom panel, said end panels meeting with said side panels to form a box with four corners;

d) two top panels, wherein each top panel is attached to a top edge of a respective one of said side panels and overlies two of said corners and at least a portion of an interior of the box, and wherein said top panels include extensions so that said top panels are slightly longer than said side panels, said extensions resting on top edges of said end panels;

e) an open, vertically extending rectangular corner support column at each corner of said box, each said rectangular corner support column consisting essentially of:

i) a corner support panel attached to a respective outer edge of each end panel, each said corner support panel also attached alongside an inner surface of the adjacent side panel, ii) a first interior bracing panel attached to each corner support panel, each said first interior bracing panel extending perpendicularly from the respective corner support panel and spaced from each respective corner of said box, and iii) a second interior bracing panel attached to each first interior bracing panel, each said second interior bracing panel extending perpendicularly from the respective first interior bracing panel to each end panel;

f) a reinforcing end panel attached to each interior bracing panel and disposed along an inner surface of a respective end panel, each said reinforcing end panel extending across substantially half of the respective end panel so that adjacent reinforcing end panels give the respective end panel a double walled thickness;

g) box top locking means for securing the top panels down over the interior of the box, said box top locking means comprising a double-thickness locking tab extending upwardly from each end panel and each reinforcing end panel and a locking aperture at each end of the top panels for engaging corresponding locking tabs;

h) stacking apertures disposed in bottom corners of the box through the bottom panel, end panels, and reinforcing end panels, said stacking apertures for engagement by the locking tabs; and i) handle apertures formed at each end of the box through the end panel and the reinforcing end panels.

* * * * *